United States Patent [19]

Grey

[11] Patent Number: 4,664,758

[45] Date of Patent: May 12, 1987

[54] ELECTROFORMING PROCESS

[75] Inventor: Henry G. Grey, Webster, N.Y.

[73] Assignee: Xerox Corporation, Stamford, Conn.

[21] Appl. No.: 791,011

[22] Filed: Oct. 24, 1985

[51] Int. Cl.[4] ..... C25D 1/20

[52] U.S. Cl. ..... 204/3

[58] Field of Search ..... 204/3, 4

[56] References Cited

U.S. PATENT DOCUMENTS 4,300,959 11/1981 Hurwitz et al. ..... 148/127

FOREIGN PATENT DOCUMENTS 57-051280 3/1982 Japan ..... 204/3
58-210187A 12/1983 Japan ..... 204/3
59-060702A 6/1984 Japan ..... 204/3

OTHER PUBLICATIONS

Product Engineering, Jun. 5, 1961, pp. 609–614.

*Primary Examiner*—T. M. Tufariello
*Attorney, Agent, or Firm*—Peter H. Kondo

[57] ABSTRACT

An electroforming process is described comprising providing an elongated electroforming mandrel core, applying a substantially uniform coating of a molten, inert, inorganic, homogeneous, electrically conductive metal or metal alloy to the mandrel core, the metal or metal alloy having a melting point and a surface tension less than the melting point and surface tension of the mandrel core, immersing the mandrel core bearing the coating in an electroforming bath having a surface tension less than the surface tension of the metal or metal alloy, depositing an electroformed metal layer on the coating, the electroformed metal layer having a melting point greater than the metal or metal alloy, melting the metal or metal alloy, and removing the electroformed metal layer from the mandrel core.

11 Claims, No Drawings

ELECTROFORMING PROCESS

BACKGROUND OF THE INVENTION

This invention relates in general to an electroforming process for using a reusable electroforming mandrel.

The fabrication of hollow articles by an electroforming process is well known. Generally, the articles are fabricated by electrodepositing a metal onto an elongated mandrel which is suspended in an electrolytic bath. The materials from which the mandrel and the electroformed article are fabricated are selected to exhibit a different coefficient of thermal expansion to permit removal of the belt from the mandrel upon cooling of the assembly. In one example of an electroforming arrangement, the mandrel comprises a core cylinder formed of aluminum which is overcoated with a thin layer of chromium and is supported and rotated in a bath of nickel sulfamate. In the process for forming large hollow articles having a large cross sectional area, it has been found that a diametric parting gap, i.e. a gap formed by the difference between the average inside electroformed article diameter and the average mandrel diameter at the parting temperature must be at least 8 mils (200 mm) and at least about 10–12 mils (0.250 mm–300 mm or 0.04–0.06 percent of the diameter of the mandrel) for reliable and rapid separation of the large article from the mandrel. For example, at a parting gap of about 6 mils (0.015 mm), high incidence of both belt and mandrel damage are encountered due to inability to effect separation of the belt from the mandrel. Various different techniques have been developed for forming and removing tubes from electroforming mandrels depending upon the cross sectional area of the electroformed tube.

A process for electroforming hollow nickel articles having a large cross sectional area onto a mandrel is described in U.S. Pat. No. 3,844,906 to R. E. Bailey et al. More specifically, the process involves establishing an electroforming zone comprising a nickel anode and a cathode comprising a support mandrel, the anode and cathode being separated by a nickel sulfamate solution maintained at a temperature of from about 140° F. (60° C.) to 150° F. (65.5° C.) and having a current density therein ranging from about 20 to 50 amps/ft$^2$ (amps/dm$^2$), imparting sufficient agitation to the solution to continuously expose the cathode to fresh solution, maintaining this solution within the zone at a stable equilibrium composition comprising:

| | |
|---|---|
| Total Nickel | 12.0 to 15.0 oz/gal (90–112.5 g/l) |
| Halide as $NiX_2.6H_2O$ | 0.11 to 0.23 mole/gal (0.44–0.92 mole/l) |
| $H_3BO_3$ | 4.5 to 6.0 oz/gal (33.7–45 g/l) |

electrolytically removing metallic and organic impurities from the solution upon egress thereof from the electroforming zone, continuously charging to the solution about 1.0 to $2.0\times10^{-4}$ moles of a stress reducing agent per mole of nickel electrolytically deposited from the solution, passing the solution through a filtering zone to remove any solid impurities therefrom, cooling the solution sufficiently to maintain the temperature within the electroforming zone upon recycle thereto at about 140° F. (60° C.) to 160° F. (65.5° C.) at the current density in the electroforming zone, and recycling the solution to the electroforming zone. The thin flexible endless nickel belt formed by this electrolytic process is recovered by cooling the nickel coated mandrel to effect the parting of the nickel belt from the mandrel due to different respective coefficients of thermal expansion.

For metal articles fabricated by electroforming on mandrels having a small cross-sectional area, the process described in U.S. Pat. No. 4,501,646 to W. G. Herbert overcomes difficulties in removing the electroformed article from the mandrel. For example, when the chromium coated aluminum mandrel described in U.S. Pat. No. 3,844,906 is fabricated into electroforming mandrels having very small diameters of less than about 1 inch, metal articles electroformed on these very small diameter mandrels are extremely difficult or even impossible to remove from the mandrel. Attempts to remove the small diameter electroformed article formed by the process described in U.S. Pat. No. 3,844,906 the can result in destruction or damage to the mandrel or the electroformed article, e.g. due to bending, scratching or denting. The entire disclosures of U.S. Pat. No. 3,844,906 and U.S. Pat. No. 4,501,646 are incorporated herein by reference.

Various materials may be utilized as temporary removable coatings from a mandrel. These coatings can be meltable to facilitate removal of an electroformed article thereon. For example, a coating of wax may be utilized as a meltable coating. However, a wax coating must be rendered conductive in order to function as an electroforming surface. The preparation of a conductive wax as well as the reclaiming of the conductive wax for subsequent use can be expensive and require additional processing steps. Moreover, wax is relatively soft and easily damaged during handling.

Japanese patent document No. J59-060702A, published Apr. 6, 1984, discloses a method of electroforming nickel stampers. The method comprises forming a thin reaction film having a low melting point on a base, embossing fine convex patterns on the film to make a master, forming a coating made of gold (alloy) on the master, forming a nickel layer by electrolytic deposition, separating a laminate comprising the gold and nickel from the master and eliminating the residual thin reaction films from the surface of the gold coat to obtain a nickel stamper. A reaction film is preferably made by reactive sputtering and preferably has a composition of TeCH. Residual film may be eliminated using ammonium persulfate. This process requires a reactive sputtering step, an embossing step, a gold deposition step and a special residual film elimination step using ammonium persulfate. The use of reactive sputtering equipment, exotic materials and multiple steps render the process complex and expensive. Moreover, since it appears that a reaction is necessary during sputtering to deposit the composition of TeCH, the deposited reaction film would appears to be unreusable.

Japanese patent document No. J5-8210 187 A relates to the formation of a parting film on the surface of a metal die, plating a layer on the parting film and peeling off the metal die to form a metal body having a configuration reversal to that of the metal die. The parting film is formed from an oxide film obtained by exposing the metal die to oxygen plasma. The oxygen plasma is applied to the surface of a substrate under oxygen pressure of 0.1–1 torr and a Ni film of about 0.2–0.3 mm in thickness is formed. The method is suitable for forming a pattern of highly integrated digital information, a deeply-grooved pattern, etc. in an electroforming process. Since the parting film is formed by the oxygen plasma, it is uniform and adhesive to the substrate. This process requires extremely high temperatures to form a parting layer and requires peeling off the metal die to form a metal body. Such an oxide film is difficult and expensive to make and does not appear to be readily reusable.

In U.S. Pat. No. 4,300,959, a method of electroforming is disclosed in which, for example, nickel and then copper is electroplated onto a wax mandrel coated with a sprayed coating of silver paint. A third layer of nickel is plated onto the copper layer and the wax mandrel is removed. The layered metallic object is heated to a point above the melting point of copper to yield a nickel electroformed object containing copper, nickel alloy. Since the wax substrate is not normally conductive, it is coated with a conductive silver coating which apparently comprises a heterogeneous mixture of silver particles, a binder , and a solvent for the binder so that the coating can be applied by spraying at room temerature to avoid melting the wax mandrel. The process disclosed in this U.S. patent requires the use of a mandrel that must be destroyed. Moreover, since the conductive coating on the wax would contaminate the wax, the coated mandrel constitutes a disposable, not a reusable material. In addition the use of an apparently heterogeneous conductive coating containing particulate material causes perturbations at the electroforming surface. In addition, a wax mandrel is highly vulnerable to surface damage prior to or during electroforming.

In order to reuse electroforming mandrels meeting precise tolerance requirements, the mandrels must be carefully handled to avoid scratching, gouging or otherwise damaging the smooth electroforming surface of the mandrel prior to, during and after each electroforming operation. Deep gouges, for example, may render the mandrel useless because electroformed articles may not be readily removed from the mandrel. Repair of damaged electroformed surfaces is normally impractical. Moreover, deformities in the surface of an electroforming mandrel can carry over to electroformed articles rendering electroformed articles useless for cosmetic reasons or for failing to meet the tolerance requirements for precision applications.

SUMMARY OF THE INVENTION

It is an object of the invention to provide an electroforming process which overcomes the above-noted disadvantages.

It is another object of this invention to provide an electroforming mandrel master core and coating that is reusable.

It is still another object of this invention to provide an electroforming process which provides a reusable mandrel having precisely controllable coatings.

It is another object of this invention to provide an electroforming process which greatly facilitates removal of electroformed metal articles from the mandrel core.

It is another object of this invention to provide an electroforming process which compensates for surface defects on a mandrel core.

It is another object of this invention to provide an electroforming process which is both simple and inexpensive.

It is another object of this invention to provide an electroforming process utilizing a mandrel having an outer layer which can readily be repaired when its electroforming surface is damaged.

The foregoing objects and others are accomplished in accordance with this invention by providing an elongated electroforming mandrel core, applying a substantially uniform coating of a molten, inert, inorganic, homogeneous, electrically conductive metal or metal alloy to the mandrel core, the metal or metal alloy having a melting point and a surface tension less than the melting point and surface tension of the mandrel core, immersing the mandrel core bearing the coating in an electroforming bath having a surface tension less than the surface tension of the metal or metal alloy, depositing an electroformed metal layer on the coating, the electroformed metal layer having a melting point greater than the metal or metal alloy, melting the metal or metal alloy, and removing the electroformed metal layer from the mandrel core.

Any suitable inert, low melting point, electrically conductive metal or metal alloy may be utilized for preparing the coated mandrel core of this invention. The low melting point metal or metal alloy should also be substantially insoluble in the electroforming bath, have a melting point higher than the operating temperature of the bath and have a melting point lower than the melting point of the mandrel core. For example, the melting point of the low melting point metal or metal alloy layer should be at least 25° C. above the operating temperature for nickel electroforming baths and at least about 50° C. above the operating temperature for copper sulphate baths. The metal or metal alloy should be homogeneous to insure uniform electrical and physical properties and to eliminate any special processing after removal from the mandrel and during reapplication. Further, the low melting point alloy should be inert and not react with the mandrel core, nickel plating solution nor with the electrodeposited metal. The low melting point alloy should be electrically conductive and have a resistivity of less than about $10^{10}$ ohm centimeters. Excellent electrical conductivity may be obtained with metal or metal alloys containing silver, lead or tin. Typical low melting point metals and metal alloys include lead, tin, cadmium-bismuth alloys (Wood's metal), tin-lead alloys (Solders), copper alloys such as Devardea's alloy (Cu 50.2, Al 44.8, Zn 5, N0.004, available from J. T. Baker Chemical Co.—melting point about 93° C.), Cerro metals, and the like.

The metal or metal alloy should wet the surface of the mandrel core. Satisfactory results may be achieved when the surface tension of the metal or metal alloy material is at least 1 dyne/cm less than the surface tension of the mandrel core. Generally, the greater the difference in surface energy, the greater the ease in controlling the thickness of thin metal or metal alloy coatings. Optimum uniformity of the metal or metal alloy on the mandrel core may be achieved when the surface tension of the metal or metal alloy layer material is at least 20 dyne/cm less than the surface tension of the mandrel core. In addition, the surface tension of the electroforming bath must be less than the surface tension of the metal or metal alloy layer. Preferably, the surface tension of the electroforming bath has a surface tension of at least about 5 dyne/cm less than the surface tension of the metal or metal alloy layer. Optimum uniform nucleation of the material to be deposited by electroforming may be achieved when the surface tension of the electroforming bath has a surface tension of between about 40 dyne/cm-500 dyne/cm less than the surface tension of the metal or metal alloy layer.

Except for any masked areas that might be placed on the mandrel, the deposited low melting point metal or metal alloy should be continuous and have a thickness of less than about 2 mils (0.05 mm) to more accurately reproduce the shape of the master mandrel core. Generally, the desired thickness of the low melting point metal or metal alloy layer depends upon the shape of the electroformed article and the type of materials utilized to form the electroformed part. For example, mono molecular films may be utilized where the mandrel perimeter progressively becomes smaller toward the free end of the mandrel, e.g. tapered to a point at the free end of the mandrel. This type of shape facilitates simple removal. Thicknesses greater than about 2 mils (51 micrometers) tend to mask details of the master mandrel core and tend to sag and affect coating thickness uniformity. For electroformed parts on a mandrel having an electroforming surface that is parallel to the axis of the mandrel, a metal or metal alloy thickness of about 0.0005 mils (0.013 mmicrometers) may be utilized. Thus the thickness should be sufficient to permit removal of the electroformed article from the mandrel without excessive force that might damage the mandrel.

Any suitable technique may be utilized to apply a thin coating of the molten metal or metal alloy to the mandrel core. Typical coating techniques include hot melt dipping, spraying, brushing, roll coating, sputtering, tinning, and the like.

The mandrel core may be of any suitable size or shape which facilitates separation of the electroformed article from the mandrel after the low melting point metal or metal alloy has been melted. Examples of typical electroforming mandrel shapes include elongated members having various configurations such as circular, oval, regular and irregular polygons such as a triangle, square, rectangle, hexagon, octagon, figure having a scalloped pattern, toothed gear pattern, and the like. The cross section may be regular in shape or irregular, (e.g. trapezoid). If desired, the cross-sectional shape may be unsymmetrical. For example, the cross-sectional shape may take the form of a cam, and the like. For mandrels having a convex polygon cross-sectional shape, the distance across adjacent peaks of the cross-sectional shape is preferably at least twice the depth of the valley between the peaks (depth of the valley being the shortest distance from an imaginary line connecting the peaks to the bottom of the valley) to facilitate removal of the electroformed articles from the mandrels without damaging the articles and to ensure uniform wall thickness. The surfaces of the mandrel cores are preferably substantially parallel to the axis of each mandrel to minimize the quantity of low melt metal or metal alloy material needed for ease of removal of the electroformed article from the mandrel core. Depending on the thickness of the low melt metal or metal alloy employed, the mandrel may even be slightly tapered, with the taper being away from the end of the mandrel from which the electroformed member is removed.

The mandrels cores employed to form the elongated electroformed hollow member may be solid. However, hollow mandrel cores or mandrel cores with a thermally conductive outer shell and heat insulating interior are preferred to prevent the mandrel core from acting as a heat sink during the melting of the metal or metal alloy to remove the electroformed layer. The mandrel core may have a low heat capacity, preferably in the range from about $\frac{1}{3}$ to about $\frac{1}{4}$ of the specific heat of the electroformed article material to minimize heat sink characteristics. A hollow mandrel core also allows heat to be applied to the interior of the mandrel core to facilitate rapid melting of the metal or metal alloy coating.

The mandrel core should be constructed from durable electrically conductive or electrically insulating material which will support the low melt metal or metal alloy coating. Typical mandrel cores include stainless steel, iron plated with chromium or nickel, nickel, titanium, aluminum plated with chromium or nickel, titanium palladium alloys, inconel 600, invar, ceramics, glasses, wood, stone, and the like. When using an electrically insulating master mandrel core, electrical contact between the electroforming surface of the mandrel with a power source can be effected by any suitable means such as sliding contacts riding on the low melt metal or metal alloy coating or a metal support chuck in physical contact with one end of the coated mandrel.

If desired, an opening may provided at one end of an electroformed member to facilitate removal of the electroformed member from the mandrel by allowing air to enter. The size of the opening is not particularly critical and can be formed by any suitable conventional technique such as masking. In other words, a suitable means to prevent a vacuum from forming during removal is desirable to speed removal of the electroformed article from the mandrel.

Any suitable metal capable of being deposited by electroforming. Typical metals that may be electroformed include, nickel, copper, cobalt, iron, gold, silver, platinum, aluminum, magnesium, calcium, uranium, lead, and the like, and the like, and alloys thereof. Generally, the electroformed hollow articles of this invention have relatively thin walls. For example, the thickness may range from about 0.0125 mm to about 0.50 mm. Normally, thicker walls are desirable for electroformed hollow articles having relatively large perimiters of more than 12.5 centimeters and which need not be flexible.

An adequate parting gap may be obtained even for electroformed articles having a small diameter or small cross-sectional area by utilizing the low melting metal or metal alloy coatings of this invention.

With the process of this invention, a wide range of electroforming baths may be used, even tensilly stressed baths, e.g. inexpensive $NiSO_4$ Watts baths. When electroforming nickel articles, the pH of the bath may be between about 3.75 and about 4.2 and the bath temperature of between about 60° C. and about 65° C.

A preferred concentration of nickel for electroforming nickel articles is between about 11 oz/gal and about 12 oz/gal with optimum being about 11.5. oz/gal.

When the boric acid concentration drops below about 15 g/l, bath control diminishes and surface flaws increase. The boric acid concentration is preferably maintained at about the saturation point at 38° C. When the boric acid concentration exceeds about 41 g/l, precipitation can occur in localized cold spots thereby interfering with the electroforming process.

To minimize surface flaws such as pitting, the surface tension of the plating solution is adjusted to between about 33 dynes per square centimeter to about 37 dynes per square centimeter. The surface tension of the solution may be maintained within this range by adding an anionic surfactant such as sodium lauryl sulfate, sodium alcohol sulfate (Duponol 80, available from E. I. duPont de Nemours and Co., Inc.), sodium hydrocarbon sulfonate (Petrowet R, available from E. I. duPont de Nemours and Co., Inc.) and the like. Up to about 0.105 g/l of an anionic surfactant may be added to the electroforming solution. The surface tension in dynes per centimeter is generally about the same as that described in U.S. Pat. No. 3,844,906. The concentration of sodium lauryl sulfate is sufficient to maintain the surface tension at about 33 dynes per centimeter to about 37 dynes per centimeter.

Saccharine is a stress reliever. However, in a concentration of more than about 2 grams per liter, it causes nickel oxide to form as a green powder rather than as a nickel deposit on core mandrels. At excess concentrations, the deposited nickel layer will often become so compressively stressed that the stress will be relieved during deposition causing the deposit to be permanently wrinkled. Consequently, one cannot depend on adding large quantities of saccharine or other stress reducers to an electroforming bath to produce the desired parting gap. Additionally, saccharine renders the deposit brittle thus limiting its uses.

A preferred current density is between about 30 amps/dm$^2$ and about 40 amps/dm$^2$. Higher current densities may be achieved by increasing the electrolyte flow, mandrel rotational speed, electrolyte agitation, and cooling. Current densities as high as 900 amps per square foot have been demonstrated.

After the electroforming operation, the electroformed metal layer on the mandrel core coated with the metal or metal alloy, is removed from the mandrel by heating the electroformed metal layer and/or the mandrel core to a temperature which is sufficient to melt the metal or metal alloy coating but insufficient to melt the electroformed metal layer and the mandrel core. Generally, to provide a margin for error during the low melting point melting of the metal or metal alloy coating, the low melting point metal or metal alloy is preferably selected from one that has a melting temperature of at least about 50° C. lower than the melting temperature of both the electrodeposited metal layer and master mandrel core. Melting to the metal or metal alloy may be effected by any suitable heating technique. Typical heating techniques include ovens, resistance heating, ratio frequency heating, heated bath (e.g. of low melting point alloy material), and the like. The parting gap created by the melting metal or metal alloy, as well as the lubricating effect provided by the molten metal or metal alloy contribute significantly to the extreme ease of removal of electroformed articles from the mandrel.

Although not necessary, parting conditions can be enhanced by cooling the outer surface of the electroformed article rapidly to cool the entire deposited coating prior to any significant cooling and contracting of the core mandrel to permanently deform the electroformed article prior to melting the metal or metal alloy coating. For permanent deformation of electroformed articles having a small cross sectional area, the rate of cooling should be sufficient to impart a stress in the electroformed article of between about 40,000 psi (2,800 kg/cm$^2$) and about 80,000 psi (5,600 k/cm$^2$) to permanently deform the electroformed article and to render the length of the inner perimeter of the electroformed article incapable of contracting to less than 0.04 percent greater than the length of the outer perimeter of the core mandrel after the core mandrel is cooled. The difference in temperature between the coating and the outer cooling medium is preferably less than the difference in temperature between the cooling medium and the temperature of the core mandrel during the stretching phase of the process to achieve sufficient permanent deformation of the electroformed article. Nickel has a low specific heat capacity and a high thermal conductivity.

The electroforming process for forming the composite article of this invention may be conducted in any suitable electroforming device. For example, a solid cylindrically shaped mandrel may be suspended vertically in an electroplating tank. The mandrel comprises a core coated with electrically conductive low melt metal or metal alloy material that is compatible with the metal plating solution. For example, the mandrel may be made of solid nickel coated with Wood's metal. The top edge of the mandrel may be masked off with a suitable nonconductive material, such as wax to prevent deposition. The mandrel may be of any suitable cross section including circular, rectangular, triangular and the like. The electroplating tank is filled with a plating solution and the temperature of the plating solution is maintained at the desired temperature. The electroplating tank can contain an annular shaped anode basket which surrounds the mandrel and which is filled with metal chips. The anode basket is disposed in axial alignment with the mandrel. The mandrel is connected to a rotatable drive shaft driven by a motor. The drive shaft and motor may be supported by suitable support members. Either the mandrel or the support for the electroplating tank may be vertically and horizontally movable to allow the mandrel to be moved into and out of the electroplating solution. Electroplating current can be supplied to the electroplating tank from a suitable DC source. The positive end of the DC source can be connected to the anode basket and the negative end of the DC source connected to a brush and a brush/split ring arrangement on the drive shaft which supports and drives the coated mandrel core. The electroplating current passes from the DC source to the anode basket, to the plating solution, the mandrel core coating, the drive shaft, the split ring, the brush, and back to the DC source. In operation, the mandrel is lowered into the electroplating tank and continuously rotated about its vertical axis. As the mandrel rotates, a layer of electroformed metal is deposited on its outer coated surface. When the layer of deposited metal has reached the desired thickness, the mandrel is removed from the electroplating tank and heated to melt the Wood's metal, coating. The deposited metal article may then be removed from the mandrel. The deposited metal article does not adhere to the mandrel coating since the mandrel coating is selected from a passive material. Consequently, as the the Wood's metal coating melts, the deposited metal article may be readily slipped off the mandrel core.

A suitable electroforming apparatus for carrying out the process described above is described, for example, in British Pat. No. 1,288,717, published Sept. 13, 1972. The entire disclosure of the British Patent Specification is incorporated herein by reference.

A typical electrolytic cell for depositing metals such a nickel may comprise a tank containing a rotary drive means including a mandrel supporting drive hub centrally mounted thereon. The drive means may also provide a low resistance conductive element for conducting a relatively high amperage electrical current between the mandrel coating (or mandrel core if the core is electrically conductive) and a power supply. The cell is adapted to draw, for example, a peak current of about 3,000 amperes DC at a potential of about 18 volts. Thus, the mandrel comprises the cathode of the cell. An anode electrode for the electrolytic cell comprises an annular shaped basket containing metallic nickel which replenishes the nickel electrodeposited out of the solution. The nickel used for the anode may comprise sulfur depolarized nickel. Suitable sulfur depolarized nickel is available under the tradenames, "SD" Electrolytic Nickel and "S" Nickel Rounds from International Nickel Co. Nonsulfur depolarized nickel can also be used such as carbonyl nickel, electrolytic nickel and the like. The nickel may be in any suitable form or configuration. Typical shapes include buttons, chips, squares, strips and the like. The basket is supported within the cell by an annular shaped basket support member which also supports an electroforming solution distributor manifold or sparger which is adapted to introduce electroforming solution to the cell and effect agitation thereof. A relatively high amperage current path within the basket is provided through a contact terminal which is attached to a current supply bus bar.

Electroforming may be carried out in a nickel sulfamate solution treating loop. For example, an article can be electroformed by preheating a mandrel comprising a coated mandrel core at a preheating station. Preheating can be effected by contacting the mandrel with a nickel sulfamate solution at about 140° F. (60° C.) for a sufficient period of time to bring the mandrel to about 140° F. (60° C.). Preheating in this manner allows the mandrel to expand to the dimensions desired in the electroforming zone and enables the electroforming operation to begin as soon as the mandrel is placed in the electroforming zone. Thereafter, the mandrel is transported from the preheating station to an electroforming zone. The electroforming zone may comprise at least one cell containing an upstanding electrically conductive rotatable spindle which is centrally located within the cell and a concentrically located container spaced therefrom which contains donor metallic nickel. The cell is filled with nickel sulfamate electroforming solution. The mandrel is positioned on the upstanding electrically conductive rotatable spindle and is rotated thereon. A DC potential is applied between the rotating mandrel cathode and the donor metallic nickel anode for a sufficient period of time to effect electrodeposition of nickel on the mandrel to a predetermined thickness of at least 30 Angstroms. Upon completion of the electroforming process, the mandrel and the nickel article formed thereon are transferred to a nickel sulfamate solution recovery zone. Within this zone, a major portion of the electroforming solution dragged out of the electroforming cell is recovered from the nickel article and mandrel. The electroformed article-bearing mandrel is then transferred to a heating zone in which the Wood's metal coating is heated in an oven to cause the Wood's metal to melt and flow. The mandrel core, melted Wood's metal coating material and electroformed article are passed to a parting and cleaning station at which the electroformed article is removed from the mandrel, sprayed with water and subsequently passed to a dryer. The mandrel core is checked for cleanliness before being recoated with Wood's metal and recycled to the preheat station to commence another electroforming cycle.

If desired, the electroformed article-bearing mandrel may be transferred, prior to melting of the Wood's metal, to a cooling zone containing water maintained at about 40° F. (4.4° C.) to 80° F. (26.7° C.) or cooler for cooling the mandrel and the electroformed article whereby the electroformed article is cooled prior to any significant cooling and contracting of the mandrel to impart a stress of between about 40,000 psi (2,800 kg/cm$^2$) and about 80,000 psi (5,600 kg/cm$^2$) to the cooled electroformed article to permanently deform the electroformed article and to render the length of the inner perimeter of the electroformed article incapable of contracting to less than about 0.4 percent greater than the length of the outer perimeter of the core mandrel after the core mandrel is cooled and contracted.

Very high current densities can be employed with a nickel sulfamate electroforming solution. Generally, the current densities range from about 150 amps per square foot to about 500 amps per square foot, with a preferred current density of about 300 amps per square foot. Current concentrations generally range from about 5 to about 20 amps per gallon.

Temperatures of above about 160° F. (71.1° C.) are normally avoided because hydrolysis of the nickel sulfamate occurs under the acid conditions maintained in the solution resulting in the generation of $NH4^+$ which is detrimental to the process as it increases tensile stress and reduces ductility in the nickel electroform.

Because of the significant effects of both temperature and solution composition on the final small cross-sectional area product as discussed herein, it is necessary to maintain the electroforming solution in a constant state of agitation thereby substantially precluding localized hot or cold spots, stratification and inhomogeneity in the composition. Moreover, constant agitation continuously exposes the coated mandrel to fresh solution and, in so doing, reduces the thickness of the cathode film thus increasing the rate of diffusion through the film and thus enhancing nickel deposition. Agitation is maintained by continuous rotation of the mandrel and by impingement of the solution on the mandrel coating and cell walls as the solution is circulated through the system. Generally the solution flow rate across the coated mandrel surface can range from about 4 linear feet per second (122 cm/sec) to about 10 linear feet per second (305 cm/sec). For example, at a current density of about 300 amps per square foot with a desired solution temperature range within the cell of about 138° F. (58.9° C.) to about 142° F. (61.1° C.), a flow rate of about 20 gal/min of solution has been found sufficient to effect proper temperature control. The combined effect of mandrel rotation and solution impingement assures uniformity of composition and temperature of the electroforming solution within the electroforming cell.

For continuous, stable operation, the composition of the aqueous nickel sulfamate solution within the electroforming zone may be as follows:

| | |
|---|---|
| Total nickel | 11 to 12 oz/gal |
| $H_3BO_3$ | 4 to 5 oz/gal |
| pH | 3.80 to 3.90 |
| Surface Tension | 33 to 37 dynes/cm$^2$ |

A metal halide, generally a nickel halide such as nickel chloride, nickel bromide, or nickel fluoride and preferably, nickel chloride, are included in the nickel sulfamate electroforming solution to avoid anode polarization. Anode polarization is evidenced by gradually increasing pH.

The pH of the nickel electroforming solution should be between about 3.8 and about 3.9. At a pH of greater than about 4.1 surface flaws such as gas pitting increase. The pH level may be maintained by the addition of an acid such as sulfamic acid, when necessary. Control of the pH range may also be assisted by the addition of a buffering agent such as boric acid within a range of about 4 oz/gal to about 5 oz/gal.

In order to maintain a continuous steady state operation, the nickel sulfamate electroforming solution can be continuously circulated through a closed solution treating loop. This loop may comprise a series of processing stations which maintain a steady state composition of the solution, regulate the temperature of the solution and remove any impurities therefrom.

The electroforming cell may contain, for example, one wall thereof which is shorter than the others and acts as a weir over which the electroforming solution continuously overflows to a trough as recirculating solution is continuously pumped into the cell via a solution distributor manifold or sparger along the bottom of the cell. The solution flows from the electroforming cell via the trough to an electropurification zone and a solution sump. The solution is then pumped to a filtration zone and to a heat exchange station and is then recycled in purified condition at a desired temperature and composition to the electroplating cell whereupon that mixture with the solution contained therein in a steady state condition set forth above are maintained on a continuous and stable basis.

The electrolytic zone removes the dissolved nobel metallic impurities from the nickel sulfamate solution prior to filtering. A metal plate of steel, or preferably stainless steel, can be mounted in the electrolytic zone to function as the cathode electrode. Anodes can be provided by a plurality of anode baskets which comprise tubular shaped metallic bodies, preferably titanium, each having a fabric anode bag. A DC potential can applied between the cathodes and the anodes of the purification station from a DC source. The electropurification zone can include a wall which extends coextensively with the wall of the solution sump zone and functions as a weir.

The solution can be replenished by the automatic addition of deionized water from a suitable source and/or by recycling solution from a nickel rinse zone. A pH meter can be employed for sensing the pH of the solution and for effecting the addition of an acid such as sulfamic acid when necessary to maintain essentially constant pH. The stress reducing agents and surfactant can be continuously added by suitable pumps.

The electroforming solution which flows from the electroforming cell is raised in temperature due to the flow of relatively large currents therein and accompanying generation of heat in the electroforming cell. Means may be provided at a heat exchanging station for cooling the electroforming solution to a lower temperature. The heat exchanger may be of any conventional design which receives a coolant such as chilled water from a cooling or refrigerating system. The electroplating solution which is cooled in the heat exchanger means can be successively pumped to a second heat exchanger which can increase the temperature of the cool solution to within relatively close limits of the desired temperature. The second heat exchanger can be heated, for example, by steam derived from a steam generator. The first cooling heat exchanger can, for example, cool the relatively warm solution from a temperature of about 145° F. or above to a temperature of about 135° F. A second warming heat exchange can heat the solution to a temperature of 140° F. The efflux from the heat exchange station can then be pumped to the electroforming cell.

The advantages of this invention include the use of a recoverable parting material which is conductive and renders a master mandrel reusable. The thickness of the renewable metal or metal alloy layer is readily controllable. Moreover, the metal or metal alloy layer functions as a lubricant during the parting process so that the electroformed article may be slid on a fluid bearing off mandrel core. Further, the melting of the metal or metal alloy layer of this invention provides an additional parting gap which greatly facilitates removal of electroformed metal articles from the master mandrel and, for relatively simple article shapes, requires merely heating and the aid of gravity to remove the electroformed articles. In addition, deviations in the uniformity of the outer surface of the master mandrel can be tolerated when utilizing the low melting metal or metal alloy layer of this invention while still achieving the removal of the electroformed article. Further, the process of this invention significantly broadens the latitude of bath compositions that may be used for electroforming hollow metal articles.

DESCRIPTION OF PREFERRED EMBODIMENTS

The following examples further define, describe and compare exemplary methods of preparing the electroformed articles of the present invention. Parts and percentages are by weight unless otherwise indicated. The examples, other than control examples, are also intended to illustrate the various preferred embodiments of the present invention. Unless indicated otherwise, all mandrels are cylindrically shaped with sides parallel to the axis.

Except as noted in the Examples, the general process conditions for the following first two Examples were constant and are set forth below:

| | |
|---|---|
| Current Density | 285 amps/ft$^2$ (28.5 amps/dm$^2$) |
| Agitation Rate (linear ft/sec solution flow over the cathode surface) | 4–6 ft/sec |
| pH | 3.8–3.9 |
| Surface Tension | 33–39 dynes/cm |
| $H_3BO_3$ | 4–5 oz/gal |
| Sodium Lauryl Sulfate | 0.0007 oz/gal (0.0052 g/L) |

EXAMPLE I

A hollow metal electroformed article was prepared with the aid of an uncoated elongated generally cylindrical mandrel core having 200 parallel raised ribs 364 mm long arranged parallel to the axis of the mandrel and uniformly spaced 1.8° spaced around the circumference of the mandrel. The peak height was 0.01 in (0.254 micrometer) and the radius of curvature for each peak and valley was about 0.127 mm. The uncoated mandrel had a supported end and a free end. A band about 2.5 wide between the free end of the mandrel and the lower end of the ribs was free of any raised ribs. The mandrel was immersed in the plating bath until all but the top 0.25 in of the ribs were covered by the bath. The dimensions of this mandrel are set forth in the table below. The uncoated mandrel was immersed vertically with the free end facing downwardly in the electroplating bath.

| | |
|---|---|
| Mandrel Core material | stainless steel (304) |
| Mandrel Core Perimeter (mm) | 62.59 |
| Mandrel Core Length (mm) | 485 |
| Mandrel Core cross sectional shape | generally circular |
| Mandrel Coating material | None |
| Mandrel Coating Thickness (micrometers) | None |
| Ni (oz/gal) | 11.5 |
| $NiCl_2.6H_2O$ (oz/gal) | 6 |
| Anode | electrolytic Ni |
| Plating Temp. (°F.) | 140 |
| Saccharin Concentration | 0 |
| 2-MBSA/Saccharine | 0 |
| Mole Ratio - Saccharine/Ni | 0 |
| Internal Stress, psi | −3,000 |
| Tensile Strength, psi | 93,000 |

The resulting hollow electroformed article could not be removed from the uncoated mandrel by vigorous attempts to pull apart the hollow electroformed article from the mandrel by hand.

EXAMPLE II

A hollow metal electroformed article may be prepared with materials and process conditions identical to that employed to prepare the hollow metal electroformed article of Example I except that an elongated cylindrical mandrel core having the same dimensions as the uncoated mandrel is coated with low melting point metal alloy. The recommended process conditions and dimensions of the coated mandrel are set forth in the table below.

| | |
|---|---|
| Mandrel Core material | nickel |
| Mandrel Core Perimeter (mm) | 62.5 |
| Mandrel Core Length (mm) | 485 |
| Mandrel Core cross sectional shape | Generally circular |
| Mandrel Coating material | 60/40 tin lead solder |
| Mandrel Coating Thickness (micrometers) | 0.025 |
| Ni (oz/gal) | 11.5 |
| $NiCl_2.6H_2O$ (oz/gal) | 6 |
| Anode | electrolytic Ni |
| Saccharin Concentration | 0 |
| 2-MBSA/Saccharine | 0 |
| Mole Ratio - Saccharine/Ni | 0 |
| Internal Stress, psi | −3,000 |
| Tensile Strength, psi | 93,000 |

The resulting hollow electroformed article on the coated mandrel can be hung vertically, with the free end facing downwardly in an electric furnace and heated until the solder melts. It is expected that the hollow electroformed article will easily be pulled by hand off the free end of the mandrel.

EXAMPLE III

A hollow metal electroformed article may be prepared with materials and process conditions identical to that employed to prepare the hollow metal electroformed article of Example I except that an elongated cylindrical mandrel core having the same dimensions as the uncoated mandrel is coated with low melting point metal alloy. The recommended process conditions and dimensions of the coated mandrel are set forth in the table below.

| | |
|---|---|
| Mandrel Core material | 98% Titanium 2% Palladium |
| Mandrel Core Perimeter (mm) | 62.59 |
| Mandrel Core Length (mm) | 485 |
| Mandrel Core cross sectional shape | Circular |

-continued

| | |
|---|---|
| Mandrel Coating material | Wood's metal |
| Mandrel Coating Thickness (micrometers) | 0.025 |
| $NiSO_4.6H_2O$ (g/L) | 330 |
| $NiCl_2.6H_2O$ (g/L) | 45 |
| Anode | electrolytic Ni |
| Current density (amp $ft^2$) | 50 |
| Plating Temp. (°C.) $T_2$ | 60 |

The resulting hollow electroformed article on the coated mandrel can be hung vertically, with the free end facing downwardly in an electric furnace and heated until the Wood's metal melts. It is expected that the hollow electroformed article will easily be pulled by hand off the free end of the mandrel.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electroforming process comprising providing an elongated electroforming mandrel core, applying a continuous, substantially uniform layer having a thickness of less than about 51 micrometers of a molten, inert, inorganic, homogeneous, electrically conductive metal or metal alloy to said mandrel core, said metal or metal alloy having a melting point less than the melting point of said mandrel core and a surface tension of at least 1 dyne/cm less than the surface tension of said mandrel core, and a resistivity of less than about $10^{10}$ ohm centimeters, solidifying said layer to form a coating, immersing said mandrel core bearing said coating in an electroforming bath having a surface tension of at least about 5 dyne/cm less than said surface tension of said metal or metal alloy, said metal or metal alloy being substantially insoluble in said electroforming bath and having a meltng point higher than the operating temperature of said bath, depositing an electroformed metal layer on said coating, said electroformed metal layer having a melting point greater than said metal or metal alloy, melting said metal or metal alloy, and removing said electroformed metal layer from said mandrel core.

2. An electroforming process according to claim 1 including recovering said metal or metal alloy and reapplying the recovered metal or metal alloy to said electroforming mandrel core to form a fresh, continuous, substantially uniform coating.

3. An electroforming process according to claim 2 including immersing said mandrel core bearing said fresh, continuous, substantially uniform coating in an electroforming bath having a surface tension less than said surface tension of said metal or metal alloy, depositing an electroformed metal layer on said fresh, continuous, substantially uniform coating, said electroformed metal layer having a melting point greater than said metal or metal alloy, melting said metal or metal alloy, and removing said electroformed metal layer from said mandrel core.

4. An electroforming process according to claim 1 wherein said mandrel core is hollow.

5. An electroforming process according to claim 1 wherein said mandrel core is is solid.

6. An electroforming process according to claim 1 wherein said mandrel core is electrically insulating.

7. An electroforming process according to claim 1 wherein said mandrel core comprises a thermally conductive outer shell and heat insulating interior.

8. An electroforming process according to claim 1 wherein said mandrel core has a specific heat of from about $\frac{1}{3}$ to about $\frac{1}{4}$ of the specific heat of said electroformed article.

9. An electroforming process according to claim 1 wherein said electroforming bath has a surface tension of between about 40 dynes/cm and about 500 dynes/cm less than said surface tension of said metal or metal alloy.

10. An electroforming process according to claim 1 wherein said metal or metal alloy has a surface tension of at least 20 dyne/cm less than the surface tension of said mandrel core.

11. An electroforming process according to claim 1 wherein said metal or metal alloy has a melting temperature of at least about 50° C. lower than the melting temperature of both said electroformed metal layer and said mandrel core.

* * * * *